US009665020B2

(12) United States Patent
Miura et al.

(10) Patent No.: US 9,665,020 B2
(45) Date of Patent: May 30, 2017

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Daisuke Miura, Tokyo (JP); Yota Ito, Mishima (JP); Takashi Anezaki, Hiratsuka (JP); Hirofumi Kumoi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/664,678

(22) Filed: Mar. 20, 2015

(65) Prior Publication Data

US 2015/0277249 A1 Oct. 1, 2015

(30) Foreign Application Priority Data

Mar. 25, 2014 (JP) ..... 2014-062357
Feb. 19, 2015 (JP) ..... 2015-031047

(51) Int. Cl.

| | |
|---|---|
| ***G03G 5/04*** | (2006.01) |
| ***G03G 5/07*** | (2006.01) |
| ***G03G 5/06*** | (2006.01) |
| ***G03G 5/05*** | (2006.01) |
| ***G03G 5/147*** | (2006.01) |

(52) U.S. Cl.

CPC ..... *G03G 5/078* (2013.01); *G03G 5/0564* (2013.01); *G03G 5/0578* (2013.01); *G03G 5/0605* (2013.01); *G03G 5/0614* (2013.01); *G03G 5/14756* (2013.01); *G03G 5/14773* (2013.01)

(58) Field of Classification Search

CPC .. G03G 5/078; G03G 5/14756; G03G 5/0578; G03G 5/0564; G03G 5/14773; G03G 5/0605; G03G 5/0614

USPC ..... 430/58.1, 58.2; 399/111

See application file for complete search history.

(56) References Cited

FOREIGN PATENT DOCUMENTS

| | | | |
|---|---|---|---|
| JP | 5-43670 | A | 2/1993 |
| JP | 5-158249 | A | 6/1993 |
| JP | 8-234468 | A | 9/1996 |
| JP | 10-39521 | A | 2/1998 |
| JP | 10-182832 | A | 7/1998 |
| JP | 2006-328416 | A | 12/2006 |
| JP | 2007-079555 | A | 3/2007 |
| JP | 2008-195905 | A | 8/2008 |
| JP | 2009-084556 | A | 4/2009 |
| JP | 2011-001458 | A | 1/2011 |

(Continued)

*Primary Examiner* — Thorl Chea

(74) *Attorney, Agent, or Firm* — Canon U.S.A. Inc., IP Division

(57) ABSTRACT

A charge transporting layer of an electrophotographic photosensitive member contains a polysiloxane resin having a terminal structure represented by the formula (1), at least one selected from the group consisting of a polycarbonate resin A having a structural unit represented by the formula (A) and a polyarylate resin B having a structural unit represented by the formula (B), and a charge transporting substance, wherein the content of the siloxane structure in the polysiloxane resin is not less than 0.5% by mass and not more than 10% by mass based on the total mass of whole resin in the charge transporting layer.

14 Claims, 1 Drawing Sheet

(56) References Cited

FOREIGN PATENT DOCUMENTS

| | | | | |
|---|---|---|---|---|
| JP | 2011-237498 | A | | 11/2011 |
| WO | 2012/057350 | | * | 5/2012 |

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member and to a process cartridge and an electrophotographic apparatus each including the electrophotographic photosensitive member.

Description of the Related Art

Some electrophotographic photosensitive members for use in process cartridges and electrophotographic apparatuses contain an organic photoconductive substance (a charge generating substance). Advantageously, such electrophotographic photosensitive members can be easily formed and manufactured with high productivity by applying a coating fluid. Electrophotographic photosensitive members generally include a support and a photosensitive layer disposed on the support.

The photosensitive layer is often a multi-layer type photosensitive layer, which includes a charge transporting layer containing a charge transporting substance disposed on a charge generating layer containing a charge generating substance.

In recent years, there has been a demand for longer-life electrophotographic apparatuses and consequently for electrophotographic photosensitive members that are less prone to mechanical degradation or electrical degradation.

Japanese Patent Laid-Open No. 10-39521 discloses a technique for improving mechanical strength by changing a binder resin for a charge transporting layer from a polycarbonate resin to a polyester resin in order to suppress mechanical degradation. A method for extending the life of a charge transporting layer by increasing the thickness of the charge transporting layer is also frequently used. However, an increase in thickness of a charge transporting layer tends to result in cissing, orange peel, streaking, or unevenness in the formation of the charge transporting layer. Japanese Patent Laid-Open No. 10-39521 also discloses a technique for reducing coating defects in order to solve this problem by adding a resin, additive agent, or oil that has a polysiloxane structure to a charge transporting layer coating fluid and thereby improving leveling in the formation of a coating film.

Japanese Patent Laid-Open No. 2011-1458 discloses a method in which a siloxane-modified polycarbonate resin is used in a charge transporting layer. Japanese Patent Laid-Open No. 2011-237498 discloses a method in which a siloxane-modified polyester resin is used in a charge transporting layer.

Although combinations of a polysiloxane resin and a polycarbonate or polyarylate resin as described in Japanese Patent Laid-Open Nos. 10-39521 and 2011-1458 can improve leveling, the polysiloxane resin tends to segregate on a lower side (charge generating layer side) of the charge transporting layer. This tends to result in poor potential characteristics in long-term use.

SUMMARY OF THE INVENTION

The present invention provides an electrophotographic photosensitive member that is less prone to image failure resulting from coating defects in a charge transporting layer (in particular, a thick charge transporting layer) and has small potential fluctuations during repeated use for extended periods.

An electrophotographic photosensitive member according to one aspect of the present invention includes a support, a charge generating layer on the support, and a charge transporting layer on the charge generating layer, wherein the charge transporting layer includes a polysiloxane resin having a siloxane structure represented by the following formula (1) at an end thereof, at least one selected from the group consisting of a polycarbonate resin A having a structural unit represented by the following formula (A) and a polyarylate resin B having a structural unit represented by the following formula (B), and a charge transporting substance, and wherein the content of the siloxane structure in the polysiloxane resin is not less than 0.5% by mass and not more than 10% by mass based on the total mass of whole resin in the charge transporting layer, (1)

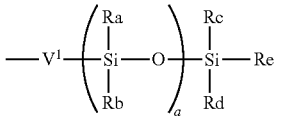

(A)

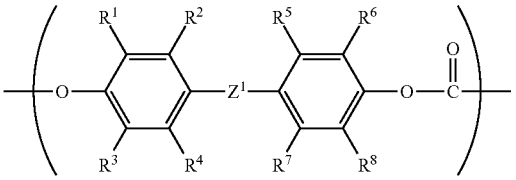

(B)

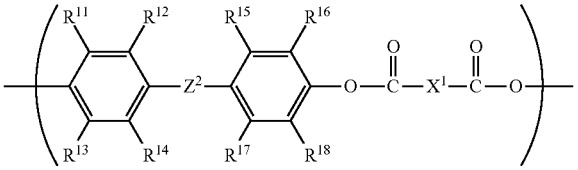

wherein, in the formula (1), (A), and (B), $V^1$ represents a divalent organic group, Ra to Re each independently represents an alkyl group or an aryl group, "a" represents number of repetitions of a structure within the bracket, and an average of "a" in the polysiloxane resin ranges from 1 to 500, $Z^1$ represents a substituted cycloalkylidene group in which 1 to 3 substituent groups are alkyl groups having 1 to 3 carbon atoms, the substituted cycloalkylidene group is 5-membered to 8-membered ring, $R^1$ to $R^8$ each independently represents a hydrogen atom or a methyl group, $Z^2$ represents a substituted cycloalkylidene group in which 1 to 3 substituent groups are alkyl groups having 1 to 3 carbon atoms, the substituted cycloalkylidene group is 5-membered to 8-membered ring, $R^{11}$ to $R^{18}$ each independently represents a hydrogen atom or a methyl group, and $X^1$ represents a divalent group represented by any one of the following formulae (2) to (5), (2)

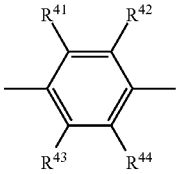

(3)

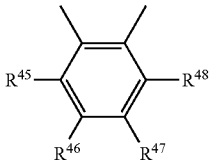

(4)

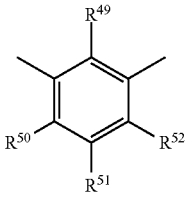

(5)

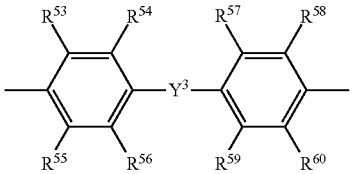

wherein, in the formulae (2) to (5), $R^{41}$ to $R^{60}$ each independently represents a hydrogen atom or a methyl group, and $Y^3$ represents a single bond, an oxygen atom, a sulfur atom, or an unsubstituted or substituted alkylene group.

The present invention also relates to a process cartridge configured to support the electrophotographic photosensitive member and at least one unit selected from the group consisting of a charging unit, a developing unit, a transferring unit, and a cleaning unit, wherein the process cartridge can be attached to and detached from a main body of an electrophotographic apparatus.

The present invention also relates to an electrophotographic apparatus that includes the electrophotographic photosensitive member, a charging unit, an exposure unit, a developing unit, and a transferring unit.

The present invention can provide an electrophotographic photosensitive member that is less prone to image failure resulting from coating defects in a charge transporting layer (in particular, a thick charge transporting layer) and has small potential fluctuations for extended periods.

Further features of the present invention will become apparent from the following description of exemplary embodiments with reference to the attached drawings.

DESCRIPTION OF THE EMBODIMENTS

Figure 1:
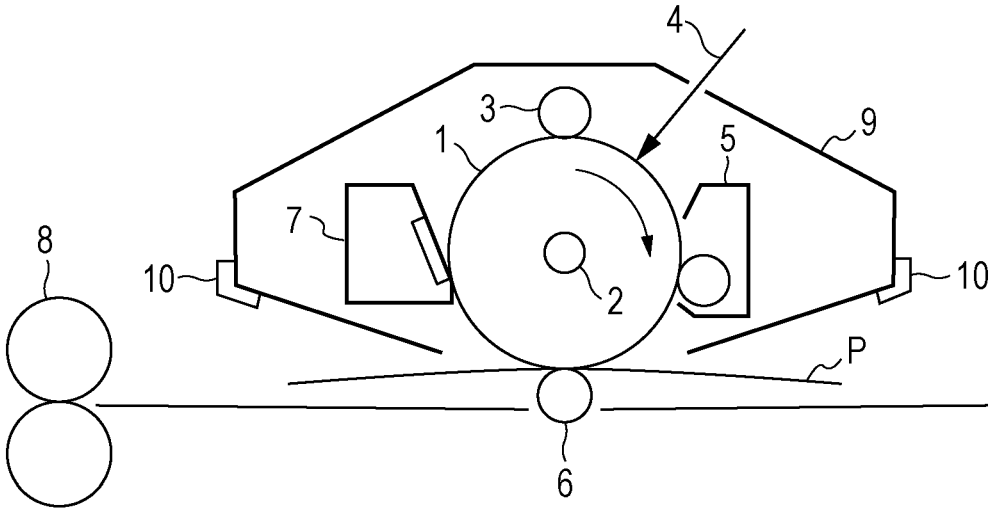
FIG. 1 is a schematic view of an electrophotographic apparatus that includes a process cartridge that includes an electrophotographic photosensitive member.

A charge transporting layer according to an embodiment of the present invention contains a polysiloxane resin, at least one selected from the group consisting of a polycarbonate resin A and a polyarylate resin B, and a charge transporting substance. The content of the siloxane structure in the polysiloxane resin is not less than 0.5% by mass and not more than 10% by mass based on the total mass of whole resin in the charge transporting layer. The polysiloxane resin has a siloxane structure represented by the following formula (1) at an end thereof. The polycarbonate resin A has a structural unit represented by the following formula (A). The polyarylate resin B has a structural unit represented by the following formula (B).

(1)

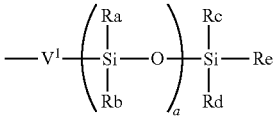

(A)

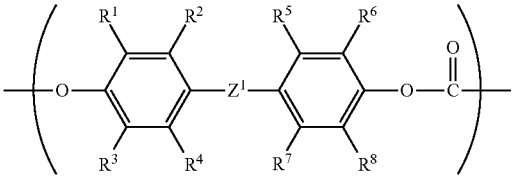

(B)

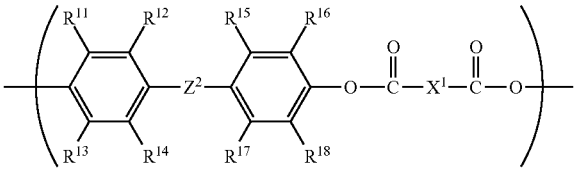

In the formula (1), (A), and (B), $V^1$ represents a divalent organic group, Ra to Re each independently represents an alkyl group or an aryl group, "a" represents number of repetitions of a structure within the bracket, and an average of "a" in the polysiloxane resin ranges from 1 to 500, $Z^1$ represents a substituted cycloalkylidene group in which 1 to 3 substituent groups are alkyl groups having 1 to 3 carbon atoms, the substituted cycloalkylidene group is 5-membered to 8-membered ring, $R^1$ to $R^8$ each independently represents a hydrogen atom or a methyl group, $Z^2$ represents a substituted cycloalkylidene group in which 1 to 3 substituent groups are alkyl groups having 1 to 3 carbon atoms, the substituted cycloalkylidene group is 5-membered to 8-membered ring, $R^{11}$ to $R^{18}$ each independently represents a hydrogen atom or a methyl group, and $X^1$ represents a divalent group represented by any one of the following formulae (2) to (5), (2)

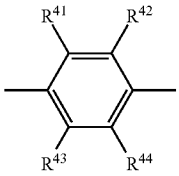

-continued (3)

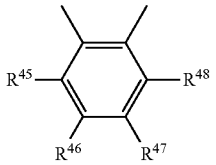

(4)

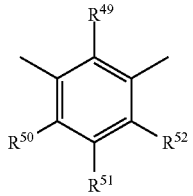

(5)

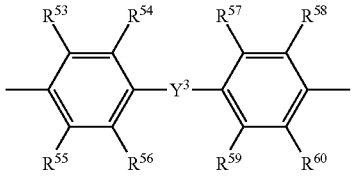

wherein, in the formulae (2) to (5), $R^{41}$ to $R^{60}$ each independently represents a hydrogen atom or a methyl group, $Y^3$ represents a single bond, an oxygen atom, a sulfur atom, or an unsubstituted or substituted alkylene group.

The polysiloxane resin, the polycarbonate resin A, and the polyarylate resin B can be used to provide an electrophotographic photosensitive member that is less prone to image failure resulting from coating defects in a charge transporting layer and has small potential fluctuations during repeated use. The present inventors believe the reason for this as described below.

In the formulae (A) and (B) of the polycarbonate resin A and polyarylate resin B, $Z^1$ and $Z^2$ represent substituted cyclohexylidene groups (5-membered to 8-membered substituted cycloalkylidene groups).

The 5-membered to 8-membered rings and the 1 to 3 alkyl substituent groups having 1 to 3 carbon atoms are probably effective in stabilizing the conformation, decreasing strain energy, and facilitating the formation of a very small space between molecules of the polycarbonate resin A or the polyarylate resin B. The very small space probably prevents the polysiloxane resin from segregating on a lower side of the charge transporting layer and stabilizes potential characteristics during repeated use. A 6-membered ring structure is more preferred.

When $Z^1$ and $Z^2$ are a 3-membered, 4-membered, or 9-membered or higher cycloalkylidene ring, the substituted cycloalkylidene group rarely has a stable structure due to high strain energy, and a very small space is rarely formed between resin molecules. Thus, the polysiloxane resin tends to segregate on a lower side of the charge transporting layer, which causes potential fluctuations during repeated use.

The 1 to 3 alkyl groups having 1 to 3 carbon atoms in the formulae (A) and (B) can be disposed at substitution positions of the cycloalkylidene group so as not to be symmetry elements of a symmetry plane passing through a carbon atom $C_z$ bound to two aromatic rings of an aromatic diol moiety in the formulae (A) and (B). Symmetry elements of a symmetry plane are described in Atkins' Physical Chemistry (first volume), eighth edition, pp. 427-428 (Japanese version). Movement from one position to its plane-symmetrical position is referred to as reflection. A symmetry plane is a term regarding the point group that refers to a plane (mirror plane) σ that defines the reflection. For example, when $Z^1$ is an unsubstituted cyclohexylidene group, a symmetry plane $\sigma_v$ includes axial and equatorial directions of $C_z$, wherein the axial direction is the principal axis direction.

This is preferred in terms of the degree of fold-over of the polycarbonate resin A and the polyarylate resin B and the compatibility with a charge transporting substance. Low molecular symmetry due to a substitution with 1 to 3 alkyl groups having 1 to 3 carbon atoms can make the fold-over of the structural units of the polycarbonate resin A and the polyarylate resin B more difficult. High compatibility with a charge transporting substance results in suppressed aggregation or crystallization of the charge transporting substance and enhances the leveling effect of the polysiloxane resin.

An electrophotographic photosensitive member according to an embodiment of the present invention includes a support, a charge generating layer on the support, and a charge transporting layer on the charge generating layer.

Figure 2:
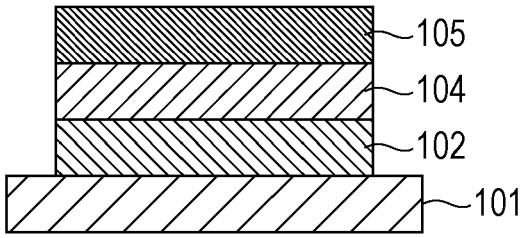
FIG. 2 is a schematic view of a layer structure of an electrophotographic photosensitive member.

FIG. 2 is a schematic view of a layer structure of an electrophotographic photosensitive member. In FIG. 2, an undercoat layer 102, a charge generating layer 104, and a charge transporting layer 105 are disposed on a support 101 in this order.

Although cylindrical electrophotographic photosensitive members that include a charge generating layer and a hole transporting layer on a cylindrical support are widely used, belt-like and sheet-like electrophotographic photosensitive members are also possible.

[Charge Transporting Layer]

A charge transporting layer according to an embodiment of the present invention contains a polysiloxane resin, at least one selected from the group consisting of a polycarbonate resin A and a polyarylate resin B, and a charge transporting substance.

$V^1$ in the formula (1) can be a divalent group represented by the following formula (6).

(6)

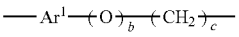

$Ar^1$ in the formula (6) represents a substituted or unsubstituted arylene group. A substituent group of the substituted arylene group is a phenoxy group or a phenylcarbonyl group. b is 0 or 1. c is an integer in the range of 1 to 10. Examples of the arylene group, include, but are not limited to, a phenylene group, a naphthylene group, and a biphenylylene group.

A main chain of a polysiloxane resin having a siloxane structure represented by the formula (1) at one end thereof has a polycarbonate or polyarylate skeleton. More specifically, a polysiloxane resin having a siloxane structure represented by the formula (1) at one end thereof has a structural unit represented by the following formula (C).

(C)

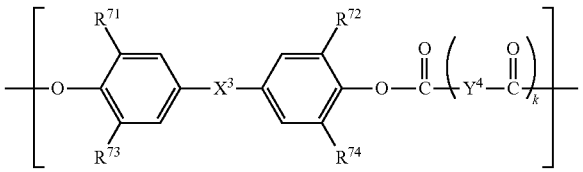

-continued (D)

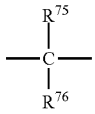

In the formula (C), $R^{71}$ to $R^{74}$ each independently represents a hydrogen atom, a methyl group, or a phenyl group. $X^3$ represents a single bond, an oxygen atom, a cyclohexylidene group, or a divalent group represented by the following formula (D). $Y^4$ is a m-phenylene group, a p-phenylene group, a cyclohexylene group, or a divalent group having two phenylene groups bonded together with an oxygen atom. $R^{71}$ to $R^{74}$ can be a methyl group. k is 0 or 1.

In the formula (D), $R^{75}$ and $R^{76}$ each independently represents a hydrogen atom, a methyl group, an ethyl group, or a phenyl group. Among these, $R^{75}$ and $R^{76}$ can be a hydrogen atom or a methyl group.

A polysiloxane resin having a siloxane structure represented by the formula (1) has the siloxane structure at one or both ends thereof. A polysiloxane resin having a siloxane structure represented by the formula (1) at one end thereof is produced using a molecular weight modifier (terminating agent). Examples of the molecular weight modifier include, but are not limited to, phenol, p-cumylphenol, p-tert-butylphenol, and benzoic acid. The molecular weight modifier can be phenol or p-tert-butylphenol.

A polysiloxane resin having a siloxane structure represented by the formula (1) at one end thereof has the following structure at the other end thereof (another terminal structure).

(T-1)

(T-2)

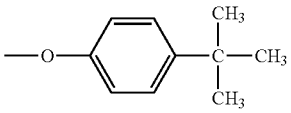

The following are specific examples of the siloxane structure represented by the formula (1).

(1-1)

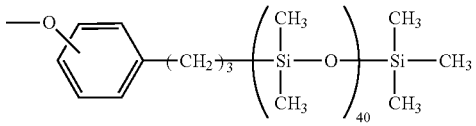

(1-2)

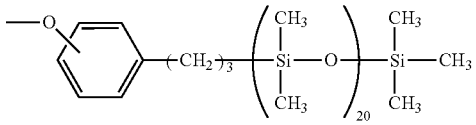

(1-3)

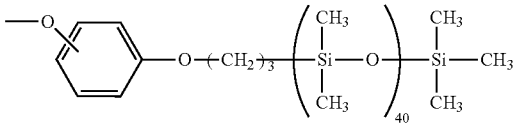

-continued (1-4)

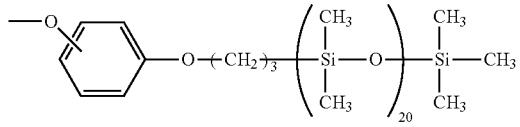

(1-5)

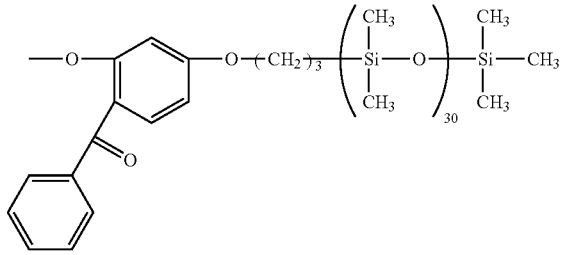

(1-6)

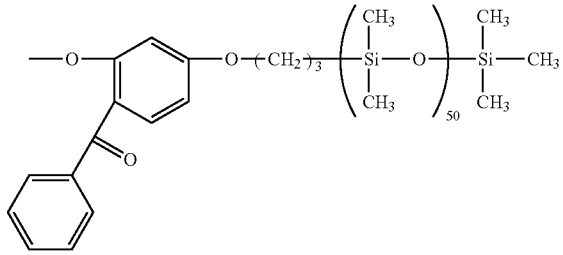

(1-7)

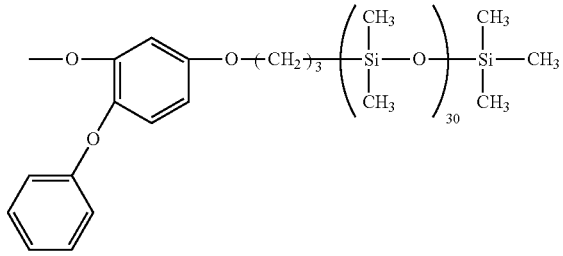

(1-8)

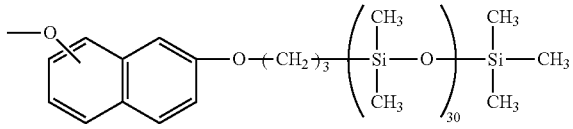

These polysiloxane resins can be synthesized using methods described in Japanese Patent Laid-Open Nos. 5-158249, 5-043670, 8-234468, 10-182832, 2009-084556, 2006-328416, and 2008-195905.

A main chain of a polysiloxane resin having a siloxane structure represented by the formula (1) at one end thereof has a polycarbonate or polyarylate skeleton. More specifically, a polysiloxane resin having a siloxane structure represented by the formula (1) has a structural unit represented by the formula (C).

The following are specific examples of the formula (C).

(C-1)

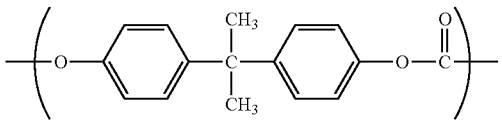

(C-2)

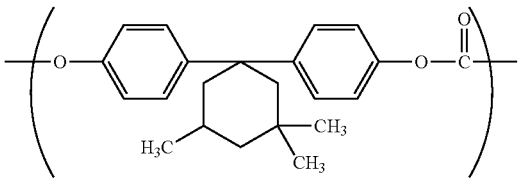

(C-3)

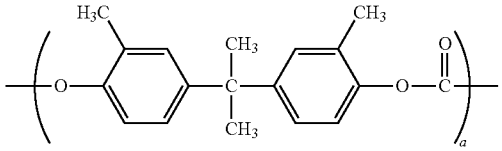

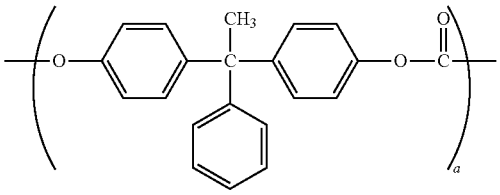

a:b = 55:45

(C-4)

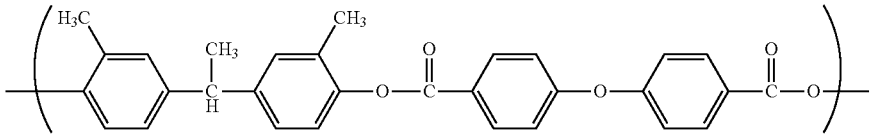

The content (mass ratio) of the siloxane structure in the polysiloxane resin can be analyzed by using a general analytical method. An example of the analytical method will be described below.

After a charge transporting layer of an electrophotographic photosensitive member is dissolved in a solvent, the materials of the charge transporting layer are fractionated with a fractionation apparatus, such as a size exclusion chromatograph or a high-performance liquid chromatograph, that can separate and collect the components of the charge transporting layer. The fractionated materials of the polysiloxane resin are subjected to $^{1}$H-NMR measurement. The structures and amounts of constituent materials can be determined from the peak position and peak area ratio of hydrogen atoms (the hydrogen atoms of the resin). On the basis of these results, the number of repetitions or the mole ratio of a siloxane structure are determined and converted into the content (mass ratio).

The mass ratio of a siloxane structure in the polysiloxane resin can be determined in such a manner. The mass ratio of a siloxane structure in the polysiloxane resin depends on the amount of raw material of a monomer unit having the siloxane structure used in polymerization. Thus, the amount of raw material is controlled so as to achieve a target mass ratio of the siloxane structure.

The content of the siloxane structure in the polysiloxane resin is not less than 0.5% by mass and not more than 10% by mass based on the total mass of whole resin in the charge transporting layer. Less than 0.5% by mass results in an insufficient leveling effect. More than 10% by mass results in a high siloxane content of the charge transporting layer and insufficient suppression of potential fluctuations even when segregation on a lower side of the charge transporting layer is decreased.

The content of the siloxane structure in the polysiloxane resin is preferably not less than 1% by mass and not more than 50% by mass based on the total mass of the polysiloxane resin.

The polysiloxane resin preferably has a weight-average molecular weight in the range of 10,000 to 150,000, more preferably 20,000 to 100,000.

Table 1 lists the synthesis examples of the polysiloxane resin.

TABLE 1

| Synthesis example | Polysiloxane resin | Terminal structure represented by formula (1) | Structural unit represented by formula (C) | Amount of structural unit represented by formula (1) (mass %) | Weight-average molecular weight (Mw) |
|---|---|---|---|---|---|
| 1 | Polysiloxane resin (1) | (1-5) | (C-1) | 4 | 40000 |
| 2 | Polysiloxane resin (2) | (1-5) | (C-2) | 4 | 40000 |
| 3 | Polysiloxane resin (3) | (1-5) | (C-3) | 4 | 40000 |
| 4 | Polysiloxane resin (4) | (1-5) | (C-4) | 4 | 40000 |
| 5 | Polysiloxane resin (5) | (1-6) | (C-3) | 4 | 40000 |
| 6 | Polysiloxane resin (6) | (1-7) | (C-3) | 4 | 40000 |
| 7 | Polysiloxane resin (7) | (1-8) | (C-3) | 4 | 40000 |
| 8 | Polysiloxane resin (8) | (1-1) | (C-3) | 4 | 40000 |
| 9 | Polysiloxane resin (9) | (1-3) | (C-3) | 4 | 40000 |

The 1 to 3 alkyl groups having 1 to 3 carbon atoms in the polycarbonate resin A and the polyarylate resin B can be 1 to 3 methyl groups.

$Z^1$ and $Z^2$ can be a divalent group represented by the formula (13-1). When $Z^1$ and $Z^2$ represent a divalent group represented by the formula (13-1), this results in decreased potential fluctuations.

(13-1)

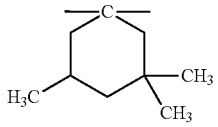

For the polyarylate resin B, $X^1$ can be a divalent group represented by the formula (5), and $Y^3$ in the formula (5) can be an oxygen atom.

The polycarbonate resin A and the polyarylate resin B preferably have a weight-average molecular weight in the range of 10,000 to 300,000, more preferably 50,000 to 150,000.

The term "weight-average molecular weight", as used herein, refers to a polystyrene equivalent weight-average molecular weight measured using a method described in Japanese Patent Laid-Open No. 2007-79555 according to routine procedures.

The following are specific examples of the polyarylate resin B.

(B5-2-1)

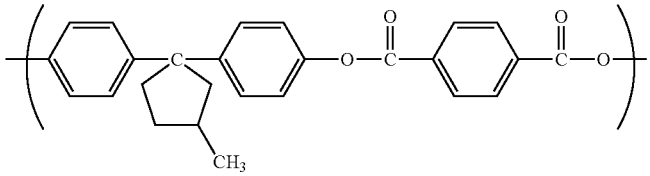

(B5-3-1)

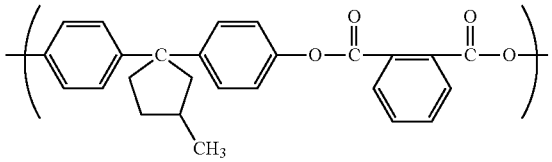

(B5-4-1)

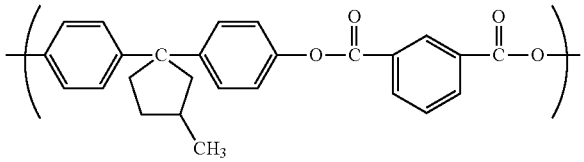

(B5-5-1)

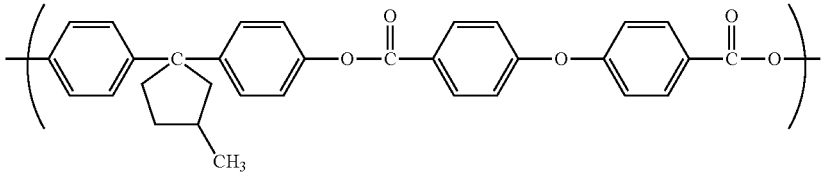

(B5-5-2)

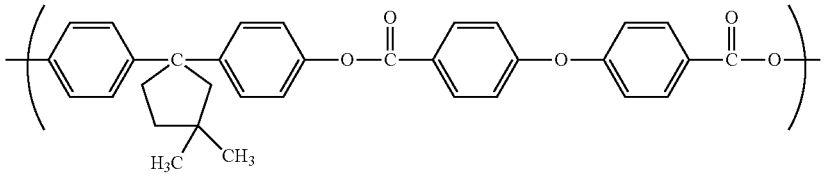

(B6-2-1)

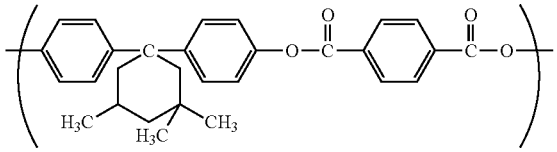

(B6-2-2)

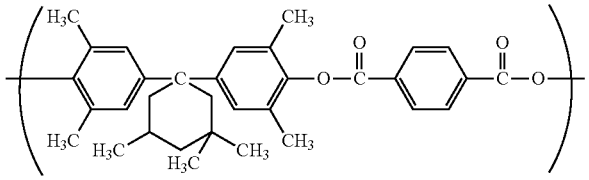

(B6-3-1)

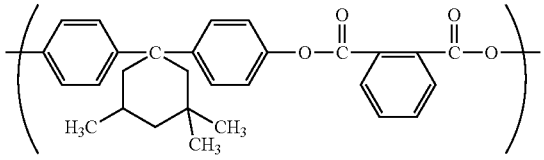

(B6-3-2)

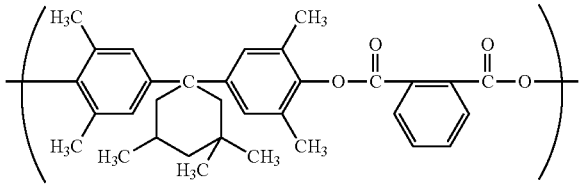

-continued
(B6-4-1)
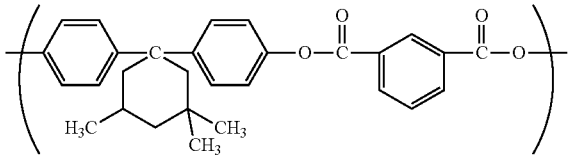
(B6-4-2)
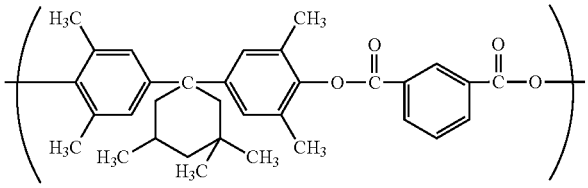
(B6-5-1)
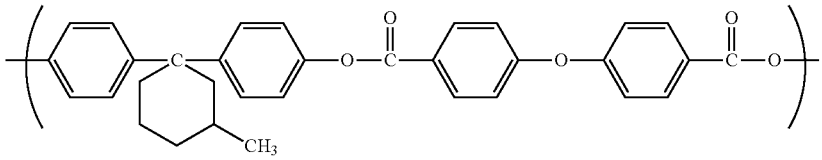
(B6-5-2)
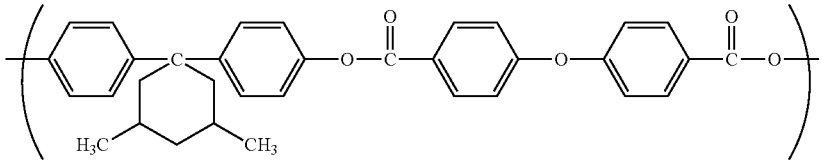
(B6-5-3)
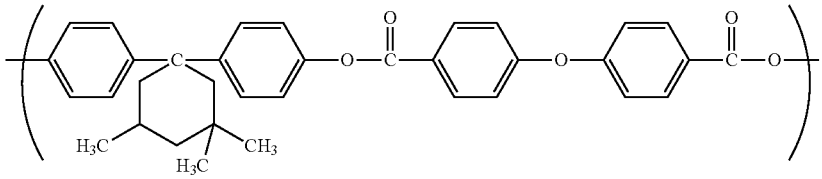
(B6-5-4)
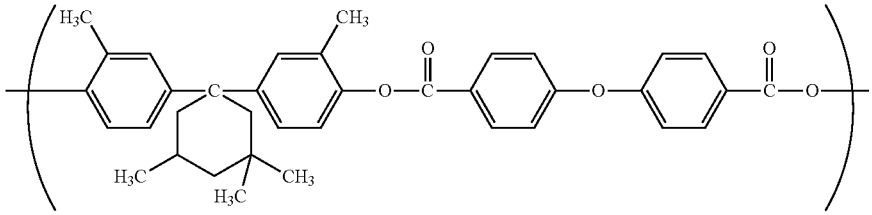
(B6-5-5)
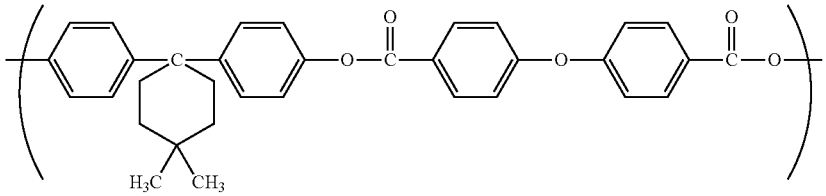
(B6-5-6)
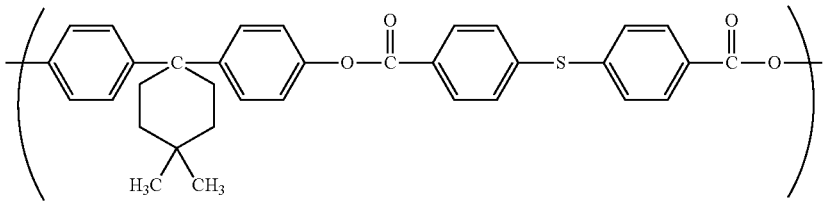
(B7-2-1)
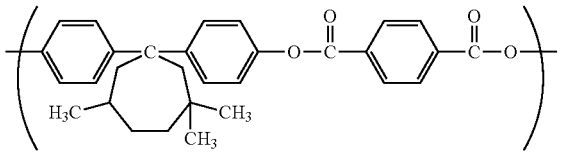
(B7-3-1)
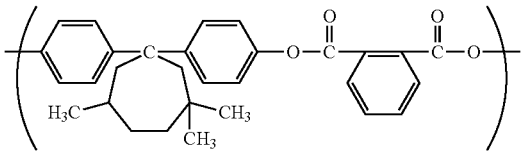

-continued
(B7-4-1)
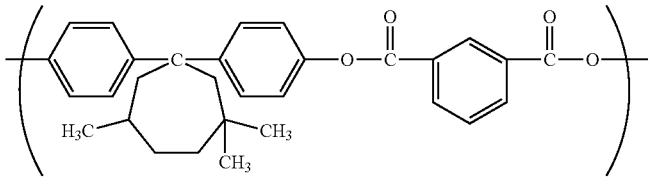
(B7-5-1)
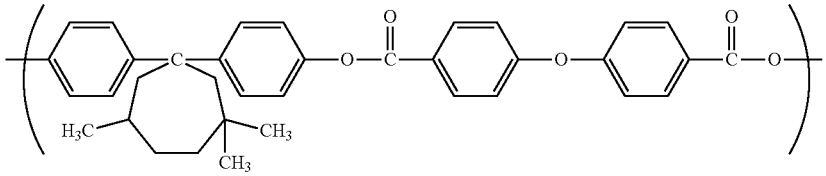
(B8-2-1)
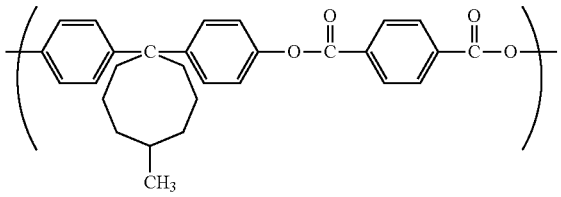
(B8-2-2)
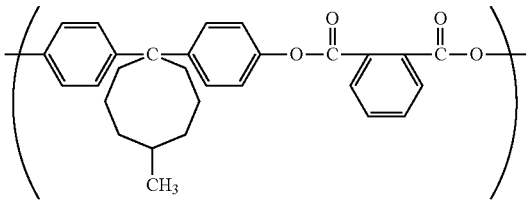
(B8-4-1)
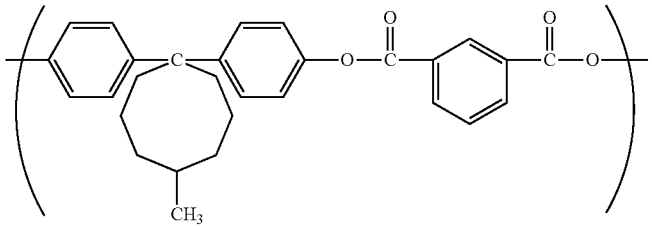
(B8-5-1)
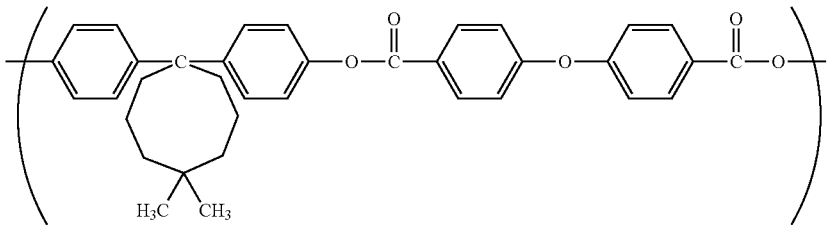
The following are specific examples of the polycarbonate resin A.
(A-1)
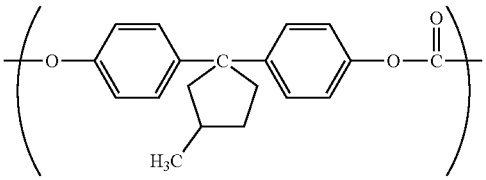
-continued
(A-2)
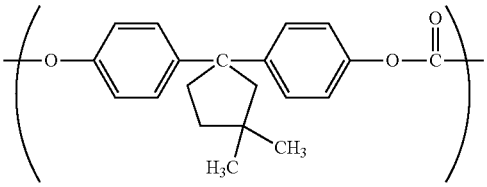

-continued (A-3)

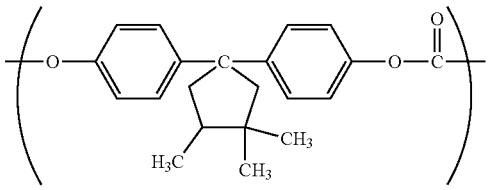

(A-4)

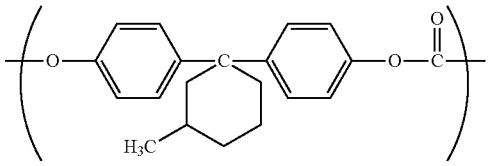

(A-5)

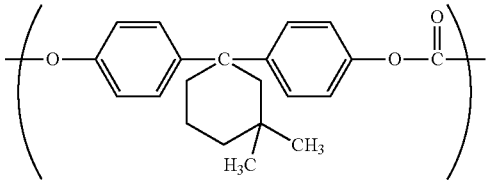

(A-6)

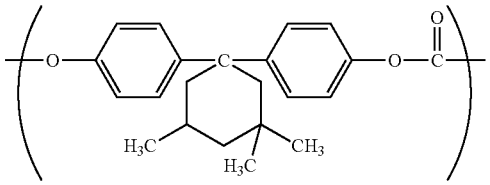

(A-7)

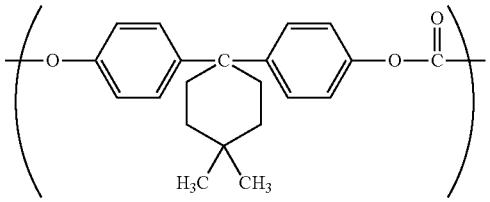

-continued (A-8)

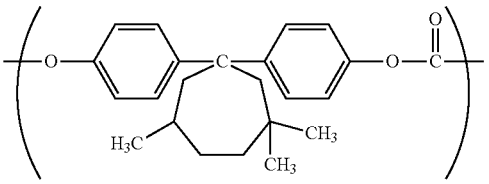

A charge transporting layer according to an embodiment of the present invention may contain the following resin, in addition to a polysiloxane resin and at least one selected from the group consisting of a polycarbonate resin A and a polyarylate resin B. For example, a charge transporting layer according to an embodiment of the present invention may contain a polymethacrylate resin, a polysulfone resin, or a polystyrene resin. A charge transporting layer according to an embodiment of the present invention may contain a polyester resin or a polycarbonate resin having a structural unit other than the structural units of the polycarbonate resin A and the polyarylate resin B.

These resins may be used in combination. These resins preferably have a weight-average molecular weight in the range of 10,000 to 300,000, more preferably 50,000 to 150,000.

Examples of a charge transporting substance in a charge transporting layer include, but are not limited to, polycyclic aromatic compounds, heterocyclic compounds, hydrazone compounds, styryl compounds, enamine compounds, benzidine compounds, triarylamine compounds, and triphenylamine compounds. Examples of a charge transporting substance also include polymers having groups derived from these compounds in a main chain or a side chain.

In order to effectively implement the present invention, a charge transporting substance preferably has a molecular weight in the range of 700 to 1200. When a charge transporting substance has a molecular weight in this range, a proper amount of charge transporting substance enters a space in a polysiloxane resin or between polysiloxane resin areas, thereby preventing precipitation of the charge transporting substance.

In order to prevent precipitation of a charge transporting substance, the charge transporting substance can have the following formula (S1) or (S2).

(S1)

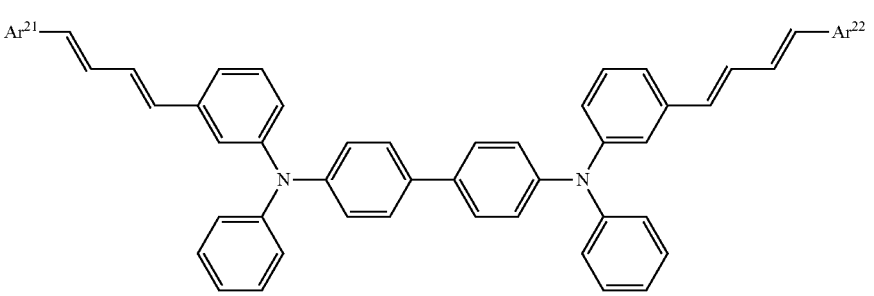

In the formula (S1), $Ar^{21}$ and $Ar^{22}$ each independently represents a phenyl group or a phenyl group substituted with a methyl group.

(S2)

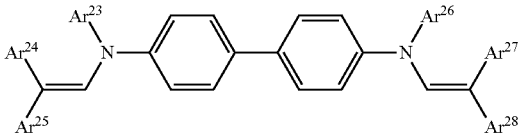

In the formula (S2), $Ar^{23}$ to $Ar^{28}$ each independently represents a phenyl group or a phenyl group substituted with a methyl group.

In a charge transporting layer according to an embodiment of the present invention, the mass ratio of a charge transporting substance to a resin preferably ranges from 10/5 to 5/10, more preferably 10/8 to 6/10. A charge transporting layer according to an embodiment of the present invention preferably has a thickness in the range of 5 to 40 μm.

Examples of a solvent for use in a charge transporting layer coating fluid include, but are not limited to, alcohol solvents, sulfoxide solvents, ketone solvents, ether solvents, ester solvents, and aromatic hydrocarbon solvents.

A diol compound represented by the following formula (7) can constitute 100 ppm or less of a polycarbonate resin A or a polyarylate resin B. This ensures stable image formation for extended periods.

(7)

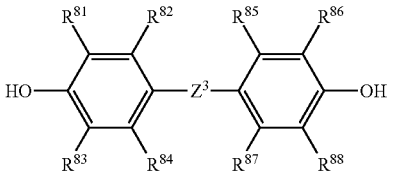

In the formula (7), $R^{81}$ to $R^{88}$ each independently represents a hydrogen atom or an alkyl group. $Z^3$ represents a substituted cycloalkylidene group in which 1 to 3 substituent groups are alkyl groups, and the substituted cycloalkylidene group is 5-membered to 8-membered ring.

It is desirable to remove an excessive (residual) amount of diol compound represented by the formula (7). The diol compound represented by the formula (7) can be removed by washing with water or ion-exchanged water or can be more effectively removed by washing with hot water or ion-exchanged water. In order to prevent decomposition of resins, the temperature of hot water or ion-exchanged water preferably ranges from 30° C. to 80° C., more preferably 50° C. or less.

A charge transporting layer according to an embodiment of the present invention may be covered with a protective layer (surface protecting layer) that contains conductive particles or a charge transporting substance and a binder resin. The protective layer may contain an additive agent, such as a lubricant. The binder resin in the protective layer may have electroconductivity or charge transporting properties. In such a case, components other than the resin, such as conductive particles and a charge transporting substance, may be omitted. The binder resin in the protective layer may be a thermoplastic resin or a curable resin, which can be cured by heat, light, or radioactive rays (such as electron beams).

Layers of an electrophotographic photosensitive member, such as a conductive layer, an undercoat layer, a charge generating layer, and a charge transporting layer, can be formed by the following method. A coating liquid can be prepared by dissolving and/or dispersing the material for each layer. The coating liquid can be applied and dried and/or cured to form a coating film. The coating liquid can be applied by dip coating, spray coating, curtain coating, spin coating, or ring coating. Among these, dip coating is efficient and productive.

[Support]

The support can be electrically conductive (a conductive support) and may be a metal or alloy support, for example, made of aluminum, iron, nickel, copper, or gold. The support may include a thin metal film, for example, formed of aluminum, chromium, silver, or gold, on an insulating support, for example, formed of a polyester resin, a polycarbonate resin, a polyimide resin, or glass. The support may include a thin film formed of a conductive material, such as indium oxide, tin oxide, or zinc oxide, or a thin film of a conductive ink containing silver nanowires on an insulating support.

In order to improve electrical characteristics or reduce interference fringes, a surface of the support may be subjected to electrochemical treatment, such as anodic oxidation, wet honing, blasting, or cutting.

[Conductive Layer]

A conductive layer may be disposed between the support and the undercoat layer.

The conductive layer can be formed by applying a conductive layer coating fluid containing conductive particles dispersed in a binder resin to the support and drying the coating fluid. Examples of the conductive particles include, but are not limited to, carbon black, acetylene black, metal powders of aluminum, iron, nickel, copper, zinc, and silver, and powders of metal oxides, such as conductive zinc oxide, tin oxide, and indium-tin oxide (ITO).

Examples of the binder resin include, but are not limited to, polyester resins, polycarbonate resins, poly(vinyl butyral) resins, acrylic resins, silicone resins, epoxy resins, melamine resins, urethane resins, phenolic resins, and alkyd resins.

Examples of the solvent of the conductive layer coating fluid include, but are not limited to, ether solvents, alcohol solvents, ketone solvents, and aromatic hydrocarbon solvents. The conductive layer preferably has a thickness in the range of 0.2 to 40 μm, more preferably 1 to 35 μm, still more preferably 5 to 30 μm.

[Undercoat Layer]

An undercoat layer may be disposed between the support or the conductive layer and the charge generating layer.

The undercoat layer can be formed by applying an undercoat layer coating fluid containing a binder resin to the support or the conductive layer and drying the coating fluid.

Examples of the binder resin for use in the undercoat layer include, but are not limited to, thermoplastic resins, such as poly(acrylic acid), methylcellulose, ethylcellulose, polyamide resins, polyimide resins, polyamideimide resins, and poly(amic acid) resins, and thermosetting resins, such as urethane resins, melamine resins, and epoxy resins. The binder resin may be a polymer having a cross-linked structure produced by thermal polymerization (curing) of a thermoplastic resin having a polymerizable functional group, such as a butyral resin, an acetal resin, or an alkyd resin, and a monomer having a polymerizable functional group, such as an isocyanate compound.

The undercoat layer preferably has a thickness in the range of 0.05 to 40 μm, more preferably 0.05 to 7 μm, still more preferably 0.1 to 2 μm.

In order to prevent accumulation of electric charges generated in the charge generating layer, the undercoat layer may contain an electron transporting substance or semiconductive particles.

[Charge Generating Layer]

A charge generating layer is disposed on the support, the conductive layer, or the undercoat layer.

Examples of a charge generating substance include, but are not limited to, azo pigments, perylene pigments, anthraquinone derivatives, anthanthrone derivatives, dibenzpyrenequinone derivatives, pyranthrone derivatives, violanthrone derivatives, isoviolanthrone derivatives, indigo derivatives, thioindigo derivatives, phthalocyanine pigments, and bisbenzimidazole derivatives. Among these, azo pigments or phthalocyanine pigments may be used. Among phthalocyanine pigments, oxytitanium phthalocyanine, chlorogallium phthalocyanine, and hydroxygallium phthalocyanine may be used.

Examples of the binder resin for use in the charge generating layer include, but are not limited to, polymers and copolymers of vinyl compounds, such as styrene, vinyl acetate, vinyl chloride, acrylate, methacrylate, vinylidene fluoride, and trifluoroethylene, poly(vinyl alcohol) resins, poly(vinyl acetal) resins, polycarbonate resins, polyester resins, polysulfone resins, poly(phenylene oxide) resins, polyurethane resins, cellulose resins, phenolic resins, melamine resins, silicon resins, and epoxy resins. Among these, polyester resins, polycarbonate resins, and poly(vinyl acetal) resins may be used. In particular, poly(vinyl acetal) resins may be used.

In a charge generating layer according to an embodiment of the present invention, the mass ratio of a charge generating substance to a binder resin preferably ranges from 10/1 to 1/10, more preferably 5/1 to 1/5. A charge generating layer according to an embodiment of the present invention preferably has a thickness in the range of 0.05 to 5 μm. Examples of a solvent for use in a charge generating layer coating fluid include, but are not limited to, alcohol solvents, sulfoxide solvents, ketone solvents, ether solvents, ester solvents, and aromatic hydrocarbon solvents.

[Process Cartridge and Electrophotographic Apparatus]

FIG. 1 is a schematic view of an electrophotographic apparatus that includes a process cartridge that includes an electrophotographic photosensitive member.

In FIG. 1, a cylindrical electrophotographic photosensitive member 1 is rotated on a shaft 2 in the direction of the arrow at a predetermined circumferential velocity. The surface of the rotating electrophotographic photosensitive member 1 is uniformly charged to a predetermined positive or negative potential with a charging unit 3 (a primary charging mechanism, such as a charging roller). The surface of the rotating electrophotographic photosensitive member 1 is then subjected to exposure light (image exposure light) 4 from an exposure unit (not shown), such as a slit exposure unit or a laser beam scanning exposure unit. In this manner, electrostatic latent images corresponding to intended images are successively formed on the surface of the electrophotographic photosensitive member 1.

An electrostatic latent image formed on the surface of the electrophotographic photosensitive member 1 is developed with toner contained in a developer of a developing unit 5 to form a toner image. The toner image on the surface of the electrophotographic photosensitive member 1 is then transferred to a transfer material (such as a paper sheet) P in response to a transfer bias from a transferring unit (such as a transfer roller) 6. The transfer material P is fed from a transfer material supply unit (not shown) to a contact portion between the electrophotographic photosensitive member 1 and the transferring unit 6 in synchronism with the rotation of the electrophotographic photosensitive member 1.

The transfer material P to which the toner image has been transferred is separated from the electrophotographic photosensitive member 1 and is sent to a fixing unit 8, in which the toner image is fixed. The resulting image-formed article (a print or copy) is then transported to the outside of the apparatus.

After toner image transfer, the surface of the electrophotographic photosensitive member 1 is cleared of residual developer (toner) with a cleaning unit (such as a cleaning blade) 7. The electrophotographic photosensitive member 1 is again used for image forming after electric charges on the surface thereof are removed with pre-exposure light (not shown) emitted from a pre-exposure unit (not shown). In the case where the charging unit 3 is a contact charging unit, such as a charging roller, as illustrated in FIG. 1, pre-exposure is not necessarily required.

At least two of the electrophotographic photosensitive member 1, the charging unit 3, the developing unit 5, the transferring unit 6, and the cleaning unit 7 can be housed in a container and used as a process cartridge. The process cartridge may be attached to and detached from a main body of an electrophotographic apparatus, such as a copying machine or a laser-beam printer. In FIG. 1, the electrophotographic photosensitive member 1, the charging unit 3, the developing unit 5, and the cleaning unit 7 are integrally supported and constitute a cartridge. A process cartridge 9 can be attached to and detached from the main body of the electrophotographic apparatus through a guide unit 10, such as a rail, for the main body of the electrophotographic apparatus.

[Toner]

A toner for use in a process cartridge or an electrophotographic apparatus that includes an electrophotographic photosensitive member according to an embodiment of the present invention can be close to spherical. More specifically, such a toner preferably has an average circularity in the range of 0.93 to 1.00, more preferably 0.95 to 0.99. Within this range, the polyarylate resin is less prone to mechanical degradation, and the toner can have high cleaning performance.

The toner preferably has a volume-average particle size in the range of 3 to 10 μm, more preferably 5 to 8 μm.

The volume-average particle size divided by the number-average particle size of the toner preferably ranges from 1.0 to 1.3, more preferably 1.0 to 1.2.

EXEMPLARY EMBODIMENTS

Although the present invention will be further described with exemplary embodiments, the present invention is not limited to these exemplary embodiments. The term "part" in the exemplary embodiments refers to "part by mass".

Exemplary Embodiment 1

An aluminum cylinder (JIS-A3003, aluminum alloy) having a length of 260.5 mm and a diameter of 30 mm was used as a support (conductive support).

214 parts of titanium oxide particles coated with oxygen-deficient tin oxide, 132 parts of a phenolic resin (trade name: Plyophen J-325, manufactured by DIC Corporation, solid content of resin: 60% by mass), and 98 parts of 1-methoxy-2-propanol were dispersed in a sand mill with 450 parts of glass beads having a diameter of 0.8 mm at a rotation speed of 2000 rpm for 4.5 hours while cooling water having a temperature of 18° C. was supplied. After dispersion, the glass beads were removed from the dispersion liquid with a mesh (sieve opening: 150 μm). After removal of the glass beads, silicone resin particles (trade name: Tospearl 120, manufactured by Momentive Performance Materials Inc., average particle size: 2 μm) were added to the dispersion liquid. The silicone resin particles constituted 10% by mass of the total mass of the metal oxide particles and the binder resin. A conductive layer coating fluid was prepared by adding a silicone oil (trade name: SH28PA, manufactured by Dow Corning Toray Co., Ltd.) serving as a leveling agent to the dispersion liquid. The silicone oil constituted 0.01% by mass of the total mass of the metal oxide particles and the binder resin in the dispersion liquid. The conductive layer coating fluid was applied to the support by dip coating and was dried and cured at 150° C. for 30 minutes to form a conductive layer having a thickness of 30 μm.

An undercoat layer coating fluid was prepared by dissolving 15 parts of an N-methoxymethylated nylon 6 resin (trade name: Toresin EF-30T, manufactured by Nagase ChemteX Corporation) and 5 parts of a copolymerized nylon resin (trade name: Amilan CM8000, manufactured by Toray Industries, Inc.) in a mixed solvent of 220 parts of methanol and 110 parts of 1-butanol. The undercoat layer coating fluid was applied to the conductive layer by dip coating and was dried at 100° C. for 10 minutes to form an undercoat layer having a thickness of 0.65 μm.

Y-type oxytitanium phthalocyanine crystals (a charge generating substance) were prepared. The crystals had a peak at a Bragg angle (2θ±0.2 degrees) of 27.3 degrees in CuKα characteristic X-ray diffractometry. 10 parts of the Y-type oxytitanium phthalocyanine crystals, 5 parts of a butyral resin (trade name: S-Lec BX-1, manufactured by Sekisui Chemical Co., Ltd.), and 260 parts of cyclohexanone were dispersed in a sand mill with glass beads having a diameter of 1 mm for 1.5 hours. 240 parts of ethyl acetate was added to the mixture to prepare a charge generating layer coating fluid. The charge generating layer coating fluid was applied to the undercoat layer by dip coating and was dried at 80° C. for 10 minutes to form a charge generating layer having a thickness of 0.20 μm.

A charge transporting layer coating fluid was prepared by dissolving 17 parts of an amine compound represented by the following formula (CTM-1) (a charge transporting substance, molecular weight: 390), 20 parts of a polyarylate resin B represented by the formula (B5-5-2) (weight-average molecular weight: 90,000), and 9 parts of a polysiloxane resin having a terminal structure represented by the formula (1-5) and a structural unit represented by the following formula (11) in a mixed solvent of 75 parts of tetrahydrofuran and 75 parts of xylene. The charge transporting layer coating fluid was applied to the charge generating layer by dip coating and was dried at 125° C. for 60 minutes to form a charge transporting layer having a thickness of 25 μm.

The content of the siloxane structure measured using the method for measuring the content of siloxane structure in the polysiloxane resin described above was 4.0% by mass based on the total mass of whole resin in the charge transporting layer. The content of the siloxane structure based on the total mass of the polysiloxane resin was 13% by mass.

The content of a diol compound represented by the formula (7) in the polyarylate resin B (B5-5-2) was measured as described below. Residual substances in the polyarylate resin B were extracted by immersing the polyarylate resin B in acetonitrile for 10 minutes. The diol compound content of the extract was determined by gas chromatography using a calibration curve. The diol compound content of the extract was 120 ppm.

(CTM-1)

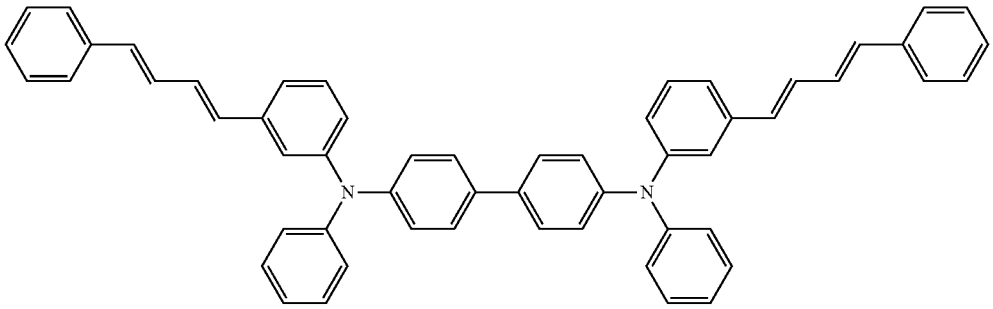

(11)

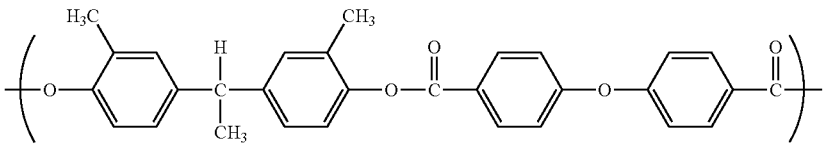

An electrophotographic photosensitive member thus manufactured included the conductive layer, the undercoat layer, the charge generating layer, and the charge transporting layer on the support.

Measurement of Potential Fluctuations

The electrophotographic photosensitive member was installed in a cyan toner process cartridge of a laser beam printer (LBP) "Color LaserJet 3800" manufactured by Hewlett-Packard Co. The laser beam printer was modified such that the process speed was 370 mm/s.

The photosensitive member in the modified laser beam printer was repeatedly used at a temperature of 15° C. and at a humidity of 10% RH. The surface potentials (dark area potential and light area potential) of the electrophotographic photosensitive member were measured at a position of a developing unit after the developing unit was replaced with a jig fixed such that a potential probe was located at 130 mm from an end portion of the electrophotographic photosensitive member. The initial dark area potential (VD) of the electrophotographic photosensitive member was set at −600 V. The initial light area potential (VL1: −150 V) was measured by attenuating the initial dark area potential (VD) by laser irradiation. After a solid black image was printed on 10,000 A4-size sheets of plain paper, the light area potential (VL2) was measured. A fluctuation in light area potential resulting from the output of the 10,000 sheets (ΔVL=|VL1−VL2|) was calculated. ΔVL in this Exemplary Embodiment 1 was 20 V.

Exemplary Embodiment 2

An electrophotographic photosensitive member was manufactured in the same manner as in Exemplary Embodiment 1 except that 20 parts of the polyarylate resin B represented by the formula (B5-5-2) was replaced with 20 parts of a polyarylate resin B represented by the formula (B6-5-1). Fluctuations in light area potential were measured. ΔVL was 20 V.

The content of the siloxane structure was 4.0% by mass based on the total mass of whole resin in the charge transporting layer.

Exemplary Embodiment 3

An electrophotographic photosensitive member was manufactured in the same manner as in Exemplary Embodiment 1 except that 20 parts of the polyarylate resin B represented by the formula (B5-5-2) was replaced with 20 parts of a polyarylate resin B represented by the formula (B6-4-1). Fluctuations in light area potential were measured. ΔVL was 15 V.

The content of the siloxane structure was 4.0% by mass based on the total mass of whole resin in the charge transporting layer.

Exemplary Embodiment 4

An electrophotographic photosensitive member was manufactured in the same manner as in Exemplary Embodiment 1 except that 20 parts of the polyarylate resin B represented by the formula (B5-5-2) was replaced with 20 parts of a polyarylate resin B represented by the formula (B6-5-3). Fluctuations in light area potential were measured. ΔVL was 10 V.

The content of the siloxane structure was 4.0% by mass based on the total mass of whole resin in the charge transporting layer.

Exemplary Embodiment 5

An electrophotographic photosensitive member was manufactured in the same manner as in Exemplary Embodiment 1 except that 20 parts of the polyarylate resin B represented by the formula (B5-5-2) was replaced with 20 parts of a polycarbonate resin A represented by the formula (A-2). Fluctuations in light area potential were measured. ΔVL was 30 V.

The content of the siloxane structure was 4.0% by mass based on the total mass of whole resin in the charge transporting layer.

Exemplary Embodiment 6

An electrophotographic photosensitive member was manufactured in the same manner as in Exemplary Embodiment 1 except that 20 parts of the polyarylate resin B represented by the formula (B5-5-2) was replaced with 20 parts of a polycarbonate resin A represented by the formula (A-5). Fluctuations in light area potential were measured. ΔVL was 30 V.

The content of the siloxane structure was 4.0% by mass based on the total mass of whole resin in the charge transporting layer.

Exemplary Embodiment 7

An electrophotographic photosensitive member was manufactured in the same manner as in Exemplary Embodiment 1 except that 20 parts of the polyarylate resin B represented by the formula (B5-5-2) was replaced with 20 parts of a polycarbonate resin A represented by the formula (A-6). Fluctuations in light area potential were measured. ΔVL was 25 V.

The content of the siloxane structure was 4.0% by mass based on the total mass of whole resin in the charge transporting layer.

Exemplary Embodiment 8

An electrophotographic photosensitive member was manufactured in the same manner as in Exemplary Embodiment 1 except that 20 parts of the polyarylate resin B represented by the formula (B5-5-2) was replaced with 20 parts of a polycarbonate resin A represented by the formula (A-8). Fluctuations in light area potential were measured. ΔVL was 20 V.

The content of the siloxane structure was 4.0% by mass based on the total mass of whole resin in the charge transporting layer.

Exemplary Embodiment 9

An electrophotographic photosensitive member was manufactured in the same manner as in Exemplary Embodiment 1 except that the amount of polysiloxane resin was changed from 9 parts to 3 parts. Fluctuations in light area potential were measured. ΔVL was 20 V.

The content of the siloxane structure was 1.7% by mass based on the total mass of whole resin in the charge transporting layer.

Exemplary Embodiment 10

An electrophotographic photosensitive member was manufactured in the same manner as in Exemplary Embodiment 1 except that the amount of polysiloxane resin was changed from 9 parts to 1.23 parts. Fluctuations in light area potential were measured. ΔVL was 20 V.

The content of the siloxane structure was 0.75% by mass based on the total mass of whole resin in the charge transporting layer.

Exemplary Embodiment 11

An electrophotographic photosensitive member was manufactured in the same manner as in Exemplary Embodiment 1 except that the amount of polysiloxane resin was changed from 9 parts to 18 parts. Fluctuations in light area potential were measured. ΔVL was 20 V.

The content of the siloxane structure was 6.2% by mass based on the total mass of whole resin in the charge transporting layer.

Exemplary Embodiment 12

An electrophotographic photosensitive member was manufactured in the same manner as in Exemplary Embodiment 1 except that the amount of polysiloxane resin was changed from 9 parts to 25 parts. Fluctuations in light area potential were measured. ΔVL was 20 V.

The content of the siloxane structure was 7.2% by mass based on the total mass of whole resin in the charge transporting layer.

Exemplary Embodiment 13

An electrophotographic photosensitive member was manufactured in the same manner as in Exemplary Embodiment 1 except that the amount of diol compound represented by the formula (7) in the polyester resin was 90 ppm. Fluctuations in light area potential were measured. ΔVL was 10 V.

Exemplary Embodiment 101

An electrophotographic photosensitive member was manufactured in the same manner as in Exemplary Embodiment 1 except that 20 parts of the polyarylate resin B represented by the formula (B5-5-2) was replaced with 20 parts of a polycarbonate resin represented by the following formula (A-9), and the structural unit represented by the formula (11) in the polysiloxane resin was replaced with a structural unit represented by the formula (C-3). Fluctuations in light area potential were measured. ΔVL was 10 V.

The content of the siloxane structure was 4.0% by mass based on the total mass of whole resin in the charge transporting layer.

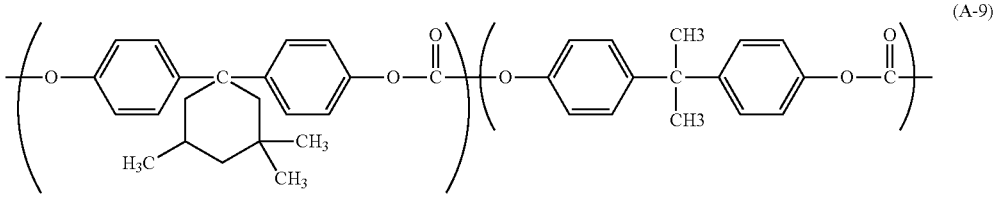

Exemplary Embodiment 102

An electrophotographic photosensitive member was manufactured in the same manner as in Exemplary Embodiment 1 except that the Y-type oxytitanium phthalocyanine crystals in the charge generating layer were replaced with hydroxygallium phthalocyanine crystals having peaks at Bragg angles (2θ±0.2 degrees) of 7.5, 9.9, 12.5, 16.3, 18.6, 25.1, and 28.3 degrees in CuKα characteristic X-ray diffractometry. Fluctuations in light area potential were measured. ΔVL was 20 V.

Exemplary Embodiment 103

An electrophotographic photosensitive member was manufactured in the same manner as in Exemplary Embodiment 1 except that the amine compound represented by the formula (CTM-1) was replaced with a compound represented by the following formula (CTM-2). Fluctuations in light area potential were measured. ΔVL was 20 V.

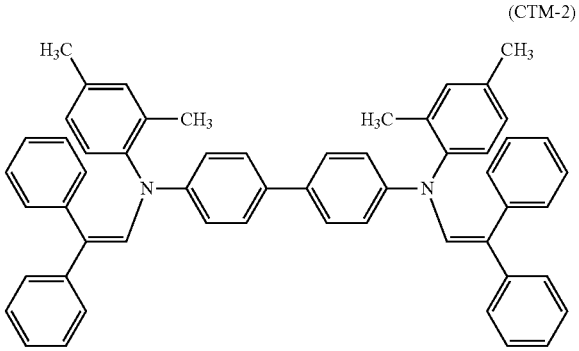

Comparative Example 1

An electrophotographic photosensitive member was manufactured in the same manner as in Exemplary Embodiment 1 except that 20 parts of the polyarylate resin B represented by the formula (B5-5-2) was replaced with 20 parts of a polyarylate resin having a structural unit represented by the following formula (11). Fluctuations in light area potential were measured. ΔVL was 50 V.

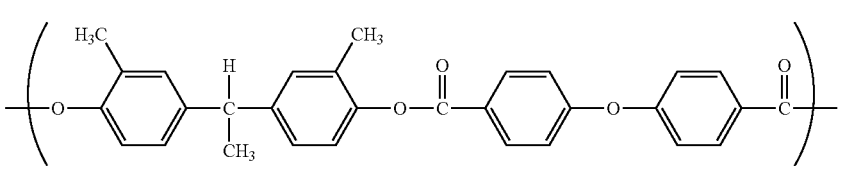

Comparative Example 2

An electrophotographic photosensitive member was manufactured in the same manner as in Exemplary Embodiment 1 except that 20 parts of the polyarylate resin B represented by the formula (B5-5-2) was replaced with 20 parts of a polycarbonate resin having a structural unit represented by the following formula (13). Fluctuations in light area potential were measured. ΔVL was 70 V.

(13)

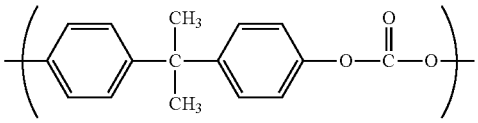

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-062357 filed Mar. 25, 2014, and No. 2015-031047 filed Feb. 19, 2015, which are hereby incorporated by reference herein in their entirety.

What is claimed is:

1. An electrophotographic photosensitive member comprising:

an electrically conductive support;

a charge generating layer on the electrically conductive support; and a charge transporting layer on the charge generating layer, wherein the charge transporting layer comprises:

a polysiloxane resin having a polycarbonate or polyarylate skeleton and a siloxane structure represented by the following formula (1) at an end of the polycarbonate or polyarylate skeleton;

a polycarbonate resin A having a structural unit represented by the following formula (A); and a charge transporting substance; and wherein the content of the siloxane structure in the polysiloxane resin is not less than 0.5% by mass and not more than 10% by mass based on the total mass of all resins in the charge transporting layer, (1)

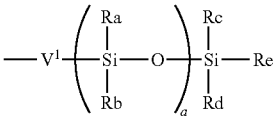

wherein, in the formula (1), $V^1$ represents a divalent organic group,

Ra to Re each independently represents an alkyl group or an aryl group,

"a" represents number of repetitions of a structure within the bracket, and an average of "a" in the polysiloxane resin ranges from 1 to 500, (A)

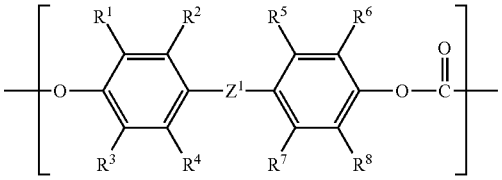

wherein, in the formula (A), $Z^1$ represents a substituted cycloalkylidene group having 1 to 3 substituent groups, the substituent groups of the substituted cycloalkylidene group are alkyl groups having 1 to 3 carbon atoms, the substituted cycloalkylidene group is 5-membered to 8-membered ring, and $R^1$ to $R^8$ each independently represents a hydrogen atom or a methyl group.

2. The electrophotographic photosensitive member according to claim 1, wherein $Z^1$ in the formula (A) represents a substituted cyclohexylidene group.

3. The electrophotographic photosensitive member according to claim 1, wherein the substituent groups of the substituted cycloalkylidene group in the formula (A) are methyl groups.

4. The electrophotographic photosensitive member according to claim 1, wherein the $Z^1$ in the formula (A) represents the following formula (13-1)

(13-1)

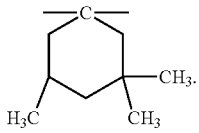

5. The electrophotographic photosensitive member according to claim 1, wherein the polycarbonate resin A has a structural unit represented by the following formula (C-1) and a structural unit represented by the following formula (C-2)

(C-1)

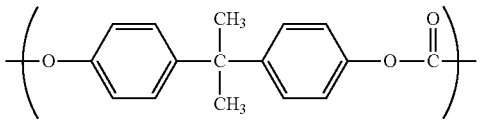

(C-2)

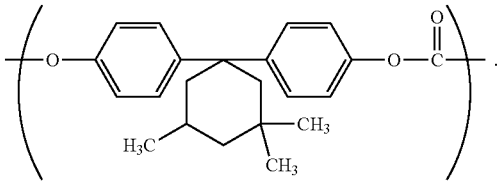

6. The electrophotographic photosensitive member according to claim 1, wherein $V^1$ in the formula (1) represents the following formula (6), $$-Ar^1-(O)_b-(CH_2)_c- \quad (6)$$

wherein, in the formula (6), $Ar^1$ represents a substituted or unsubstituted arylene group, a substituent group of the substituted arylene group is a phenoxy group or a phenylcarbonyl group, b is 0 or 1, and c is an integer in the range of 1 to 10.

7. The electrophotographic photosensitive member according to claim 1, wherein the content of a diol compound represented by the following formula (7) in the polycarbonate resin A is 100 ppm or less based on the polycarbonate resin A,

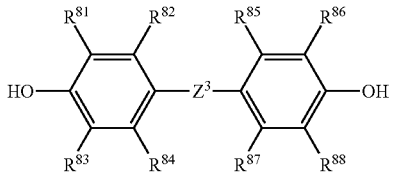

(7)

wherein, in the formula (7), $R^{81}$ to $R^{88}$ each independently represents a hydrogen atom or an alkyl group, $Z^3$ represents a substituted cycloalkylidene group in which 1 to 3 substituent groups are alkyl groups having 1 to 3 carbon atoms, and the substituted cycloalkylidene group is 5-membered to 8-membered ring.

8. The electrophotographic photosensitive member according to claim 1, wherein the polysiloxane resin further has a structural unit represented by the following formula (C):

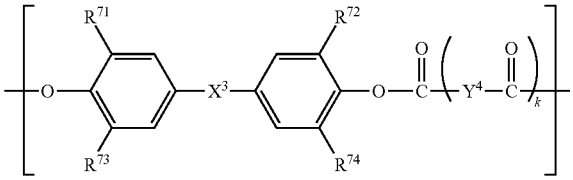

(C)

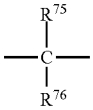

(D)

wherein, in the formula (C), $R^{71}$ to $R^{74}$ each independently represents a hydrogen atom, a methyl group, or a phenyl group, $X^3$ represents a single bond, an oxygen atom, a cyclohexylidene group, or a divalent group represented by the following formula (D), $Y^4$ is a m-phenylene group, a p-phenylene group, a cyclohexylene group, or a divalent group having two phenylene groups bonded together with an oxygen atom, and k is 0 or 1, and wherein, in the formula (D), $R^{75}$ and $R^{76}$ each independently represents a hydrogen atom, a methyl group, an ethyl group, or a phenyl group.

9. The electrophotographic photosensitive member according to claim 1, wherein the charge transporting substance is at least one selected from the group consisting of styryl compounds, enamine compounds, benzidine compounds, and triarylamine compounds.

10. A process cartridge configured to support the electrophotographic photosensitive member according to claim 1 and at least one unit selected from the group consisting of a charging unit, a developing unit, a transferring unit, and a cleaning unit, wherein the process cartridge can be attached to and detached from an electrophotographic apparatus.

11. An electrophotographic apparatus comprising: the electrophotographic photosensitive member according to claim 1; a charging unit; an exposure unit; a developing unit; and a transferring unit.

12. An electrophotographic photosensitive member comprising:

an electrically conductive support;

a charge generating layer on the electrically conductive support; and a charge transporting layer on the charge generating layer, wherein the charge transporting layer comprises:

a polysiloxane resin having a polycarbonate or polyarylate skeleton and a siloxane structure represented by the following formula (1) at an end of the polycarbonate or polyarylate skeleton; and a polyarylate resin B having a structural unit represented by the following formula (B); and a charge transporting substance; and wherein the content of the siloxane structure in the polysiloxane resin is not less than 0.5% by mass and not more than 10% by mass based on the total mass of all resins in the charge transporting layer,

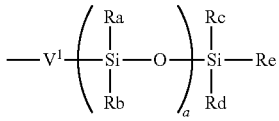

(1)

wherein, in the formula (1), $V^1$ represents a divalent organic group,

Ra to Re each independently represents an alkyl group or an aryl group,

"a" represents number of repetitions of a structure within the bracket, and an average of "a" in the polysiloxane resin ranges from 1 to 500,

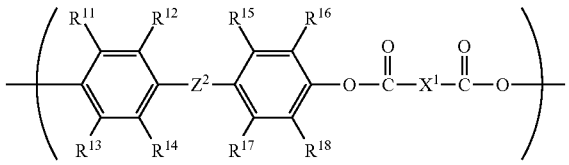

(B)

wherein, in the formula (B), $Z^2$ represents a substituted cycloalkylidene group having 1 to 3 substituent groups, the substituent groups of the substituted cycloalkylidene group are alkyl groups having 1 to 3 carbon atoms, the substituted cycloalkylidene group is 5-membered to 8-membered ring, $R^{11}$ to $R^{18}$ each independently represents a hydrogen atom or a methyl group, and $X^1$ represents any one of the following formulae (2) to (5), (2)

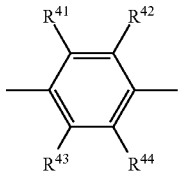

(3)

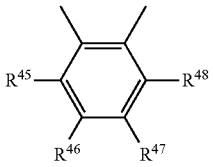

(4)

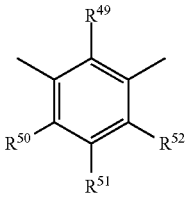

-continued (5)

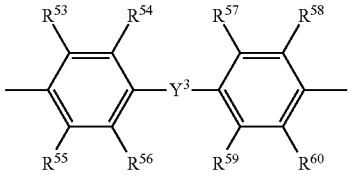

wherein, in the formulae (2) to (5), $R^{41}$ to $R^{60}$ each independently represents a hydrogen atom or a methyl group, and $Y^3$ represents a single bond, an oxygen atom, a sulfur atom, or an unsubstituted or substituted alkylene group.

13. The electrophotographic photosensitive member according to claim 12, wherein the $X^1$ in the formula (B) represents the formula (5), and the $Y^3$ represents an oxygen atom.

14. The electrophotographic photosensitive member according to claim 12, wherein the $Z^2$ in the formula (B) represents the following formula (13-1)

(13-1)

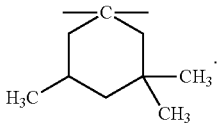

* * * * *